United States Patent [19]

Augis et al.

[11] 4,401,524

[45] Aug. 30, 1983

[54] PROCESS FOR PRODUCING GOLD PLATED CONTACTS

[75] Inventors: Jacques A. Augis, Pickerington; Erhard T. Eisenmann, Columbus, both of Ohio

[73] Assignee: Bell Telephone Laboratories, Incorporated, Murray Hill, N.J.

[21] Appl. No.: 277,859

[22] Filed: Jun. 26, 1981

Related U.S. Application Data

[63] Continuation of Ser. No. 73,689, Sep. 10, 1979, abandoned.

[51] Int. Cl.[3] ..... C25D 5/50

[52] U.S. Cl. ..... 204/37 R; 204/43 G

[58] Field of Search ..... 204/37 R, 43 G, 46 G; 200/266; 427/125

[56] References Cited

U.S. PATENT DOCUMENTS 3,551,302 12/1970 Woods et al. ..... 204/32
3,711,383 1/1973 Schiekel et al. ..... 204/29

OTHER PUBLICATIONS

Ch. J. Raub et al., *The Properties of Gold Electrodeposits . . . , Plating and Surface Finishing,* Jan. 1976, pp. 35–40.
E. Raub, *Theoretical and Practical Aspects of Alloy Plating, Plating and Surface Finishing,* Mar. 1976, pp. 30–43.
M. R. Pinnel et al., *The Metallurgy of Remendur . . . , The Bell System Technical Journal,* vol. 52, No. 8, (Oct. 1973), pp. 1325–1340.
M. R. Pinnel, *Magnetic Materials for Dry Reed Contacts, IEEE Transactions on Magnetics,* vol. MAG-12, No. 6, (Nov. 1976), pp. 789–794.
*Metal Finishing Guidebook and Directory 1978,* Nathaniel Hall, editor, *Metals and Plastics Publications, Inc.,* Hackensack, N.J. pp. 236, 240, 246, 248.
M. R. Pinnel et al., *Influence of Annealing Temperature . . . , IEEE Transactions on Magnetics,* vol. MAG-11, No. 3 (May, 1975), pp. 901–907.
J. A. Augis et al., *A New Mechanism for Lateral Erosion, IEEE Transactions on Components, Hybrids, and Manufacturing Technology,* vol. CHMT-3, No. 2, (Jun. 1980), pp. 292–296.

*Primary Examiner*—Winston A. Douglas
*Assistant Examiner*—William Leader
*Attorney, Agent, or Firm*—Walter G. Nilsen

[57] ABSTRACT

A process is described for heat-treating a gold contact surface so as to increase lifetimes and render it more reliable particularly for high current operation. A particular advantage of this procedure is that it can be carried out at a low enough temperature so that magnetic properties of certain types of contacts will not be affected.

11 Claims, 2 Drawing Figures

PROCESS FOR PRODUCING GOLD PLATED CONTACTS

This is a continuation of application Ser. No. 73,689, filed Sept. 10, 1979, now abandoned.

TECHNICAL FIELD

The invention involves a process for producing electrical contacts.

BACKGROUND OF THE INVENTION

Electrical contacts are extensively used in modern electronic equipment. Gold is particularly suitable as an electrical contact material because of its excellent conductivity properties, its chemical inertness and relative availability compared to other noble metals. In addition, gold can be put down in the form of film on surfaces using a large variety of relatively simple processes. For example, gold can be electrolessly plated onto catalytic surface metals and also electroplated onto various suitable metallic surfaces. In addition, gold can be sputtered or evaporated to form films suitable for electrical contacts.

The main advantages of gold in contact applications are good electrical conductivity and chemical inertness. Chemical inertness prevents a gold from forming an oxide film which would make good electrical contact difficult. Because of these two favorable properties of gold, gold contacts can be made with extremely small contact resistance. Also, the contacts are not degraded by exposure to corrosive atmospheres over long periods of time.

In some electrical contact applications, it is desirable to have the gold contact surface in the form of spongy gold rather than dense gold. Such structures have been mentioned in the literature (Ch. J. Raub et al, Journal of the American Electroplator's Society, *Plating and Surface Finishing* Volume 63, Number (January 1976) page 35. Producing such spongy gold surfaces requires a heat treatment which is often detrimental to the contact device being fabricated. Such processes often involve high temperatures which adversely affect certain types of magnetic materials used in magnetic contact reeds. In addition, it would be economically advantageous to be able to carry out the process without a vacuum and over a shorter period of time. For this reason, it is advantageous to develop processes for rendering gold surfaces spongy which do not adversely affect other parts of the contact device.

SUMMARY OF THE INVENTION

The invention is a process for making gold-surfaced electrical contacts in which the gold surface is heat-treated in a reducing atmosphere at a temperature above 350 degrees C. for at least one minute. The gold surface is produced by electroplating from a gold plating solution containing gold and cyanide. On heat treatment, the surface becomes spongy which leads to greater contact reliability and longevity. The particular advantage of this process is the lower temperature required in the heat treatment which permits treatment of magnetic relay devices (dry reed sealed magnetic contacts) without affecting the magnetic properties of the reeds.

DETAILED DESCRIPTION

Figure 1:
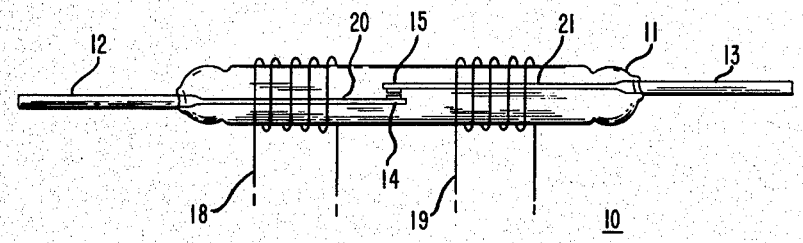
FIG. 1 shows a side view of a magnetically operated dry reed seal contact with contacts made in accordance with the invention.

The invention is a process for producing a gold electrical contact with a spongy surface configuration. The process includes a particular type of hard gold electroplating procedure as well as heat treatment in a reducing atmosphere.

Although the exact mechanism for producing spongy gold contacts is not known, it is dependent on the procedure used to produce the gold film.

In broadest terms, the gold electroplating should be carried out from an electrolyte bath containing gold and cyanide. Good results are obtained where at least 0.05 molar gold and at least 0.001 molar cobalt or nickel are present in the bath. A pH less than 8 gives good results. Other optional components of the gold bath might include salt to improve conduction and substances to stabilize pH. Typical bath compositions are given in various references including *Modern Electroplating*, edited by F. A. Lowenheim, John Wiley & Sons, New York, third edition, 1974; *Gold Plating Technology* by Frank H. Reid and William Goldie, Electrochemical Publications Ltd., 1974; and Publications Ltd., 1974; and *Gold Usage* by W. S. Rapson and T. Groenewald, Academic Press, New York, 1978.

Preferred plating procedures are described which permit heat treatment at much lower temperatures and for shorter periods of time. The basic electrolyte is citrate ion (usually added as potassium citrate) preferably with a concentration between 0.5 and 1.5 moles/liter. Cobalt (or nickel) concentration preferably is between 0.005 and 0.01 moles/liter and pH between 3 and 5. The pH is adjusted by the addition of acid or base if necessary. Most preferred is a pH of 4±0.1.

Table 1 gives preferred gold plating conditions which permit heat treatment at as low a temperature of 350 degrees C.

TABLE I

| $C_{Au(CN)}$—[M] | Current Density [mA/cm$^2$] | Temperature [Degrees C.] |
|---|---|---|
| 0.5 | 20–70 | 30–70 |
| 0.2 | 10–50 | 25–50 |
| 0.1 | 5–20 | 20–30 |
| 0.05 | 2–5 | 15–20 |

It is preferred that only moderate agitation of the plating bath be provided since excess agitation tends to narrow the range of current density.

It is convenient to define a preferred region of gold concentration, current density and plating temperature for the practice of the invention. Although the exact mechanism for producing the spongy gold film at low temperature is not known, it is believed that incorporation of foreign matter including organic matter in the gold plating enhances production of the spongy gold on heat treatment. The gold concentration in terms of $Au(CN)_2^-$ is at least 0.03 moles/liter at which concentration, the plating temperature is 15±2 degrees C. and the current density $2 \pm 0.2$ mA/cm$^2$. This gives a plating rate of about 1.5 microns per hour.

Higher gold concentrations are preferred. A gold concentration range from 0.05 moles/liter to 0.5 moles/liter is preferred. The higher part of the range is favorable because it yields the desired spongy gold surface (on heat treating) more easily and in less time. The lower part of the range is favored because of economic considerations.

The range of current densities preferred in the practice of the invention depends on concentration. The lower part of the preferred range extends from two milliamps per square centimeter at a concentration of 0.05 moles/liter and increases linearly with concentration to 20 milliamps per cm$^2$ at a gold concentration of 0.5 mole/liter. The maximum limit of the preferred current density range is 5 milliamps per cm$^2$ for a gold concentration of 0.05 moles/liter and increases linearly with concentration to a preferred maximum of 70 milliamps per cm$^2$ for a gold concentration of 0.5 moles/liter.

In a similar way, the preferred plating temperature range also depends on gold concentration. At a gold concentration of 0.05 moles/liter, the lower limit of the temperature range is 15 degrees C. and this lower limit increases linearly with gold concentration to 30 degrees C. for a gold concentration of 0.5 moles/liter. The maximum temperature of the preferred range begins at 20 degrees C. for a gold concentration of 0.05 moles/liter and extends linearly with a concentration to a temperature of 70 degrees C. for a gold concentration of 0.5 moles/liter. Generally lower plating temperatures than are generally used for most applications are preferred because they yield gold platings which more easily yield a spongy structure on heat treatment.

A major advantage of the present process is that a spongy gold structure can be obtained at a lower temperature without the use of vacuum and in a shorter time with greater uniformity with thinner gold deposits. The process should be carried out at a temperature of at least 350 degrees C. and in a reducing atmosphere. Temperatures up to 650 degrees C. may be used, but the lower temperature range is preferred particularly where magnetic materials are used in the contact device. Exposure times between one minute and three hours are required to yield the spongy gold surface.

Gold films may vary in thickness over wide ranges but should usually be greater than 1 $\mu$m. Generally, a range from 2–5 $\mu$m is most useful. This range of thickness minimizes the amount of gold used, but is usually thick enough to prevent premature wear out.

A variety of reducing atmospheres may be used including various organic compounds and other materials which on heat treatment yield reducing atmospheres. A hydrogen atmosphere (either in pure form or mixed with an inert carrier gas such as nitrogen) is preferred. A hydrogen concentration of at least 5% by volume yields perfectly good results. Hydrogen gas is preferred both because of its availability and the lower temperature at which the spongy surface is formed.

The inventive process is particularly suitable for various contact devices which are magnetically operated. The reason for this is that many magnetic materials which are used in switching devices such as remreed switches are adversely affected by high temperature heat treatments. For this reason, the possibility of developing the spongy surface structure at low temperatures and reasonably short times is highly advantageous.

Various magnetic materials may be used in the switch including both soft and hard materials. Typical materials are various iron-cobalt alloys including remendur and permally and various materials disclosed in the *Bell System Technical Journal* for January 1960, at page 1 et seq.

Figure 2:
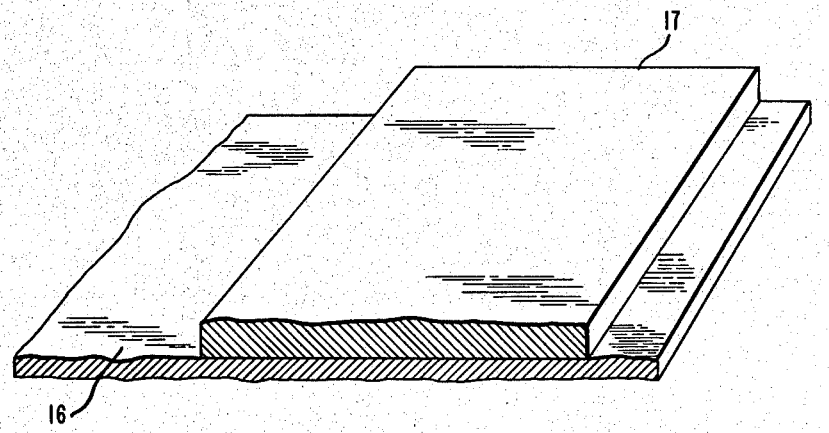
FIG. 2 shows a view in perspective of a paddle useful in electrical contact devices made in accordance with the invention.

FIG. 1 shows a typical remreed sealed contact device 10 with glass envelope 11 containing two reeds 12 and 13, each of which is provided with contacting regions 14 and 15 respectively. The contacting area is shown in greater detail in FIG. 2 where the flat magnetic material 16 (for example, remendur) is shown together with the gold plated contact 17. The gold contact area after heat treatment in the reducing atmosphere in accordance with the invention assumes a spongy-like structure.

The magnetic switch is actuated by input coils 18 and 19 which produce a magnetic force on the magnetic remreeds 12 and 13. Part of the magnetic remreeds (20 and 21) inside the glass envelope are flattened.

What is claimed is:

1. A process for producing electrical contacts comprising heat treating of a gold electroplated surface in which the gold electroplated surface is fabricated by electroplating a gold film on a substrate consisting essentially of remendur from an aqueous solution containing gold and cyanide with pH between 3 and 5

CHARACTERIZED IN THAT the heat treatment of the gold electroplated surface is carried out in a reducing atmosphere at a temperature of approximately 350 degrees C. for between one minute and three hours so as to produce a spongy gold contact surface without affecting the magnetic properties of the remendur.

2. The process of claim 1 in which the reducing atmosphere comprises at least 5 percent by volume hydrogen, remainder inert gas.

3. The process of claim 2 in which the reducing atmosphere consists essentially of hydrogen.

4. The process of claim 1 in which the aqueous solution comprises at least 0.03 molar gold, at least 0.001 molar cobalt or nickel, and the process is carried out at a current density between 2 and 70 milliamperes per square centimeter and a temperature between 15 and 70 degrees C.

5. The process of claim 4 in which the aqueous solution comprises $Au(CN)_2^-$ in the concentration range between 0.05 and 0.5 moles/liter and the aqueous solution further comprises citrate ions.

6. The process of claim 5 in which the lower range of current density is two milliamps per square centimeter at a gold concentration of 0.05 moles per liter and said lower range of current density increases linearly with gold concentration to 20 milliamps per square centimeter at a gold concentration of 0.5 moles per liter and the maximum range of current density is 5 milliamps per square centimeter for a gold concentration of 0.05 moles per liter and increases linearly with concentration to a preferred maximum of 70 milliamps per square centimeter for a gold concentration of 0.5 moles per liter.

7. The process of claim 6 in which the lower range of bath temperature for electroplating is 15 degrees C. for a gold concentration of 0.05 moles per liter and increases linearly with concentration to 30 degrees C. for a gold concentration of 0.5 moles per liter and the upper range of bath temperature is 20 degrees C. for a gold concentration of 0.05 moles per liter and increases linearly with concentration to a temperature of 70 degrees C. for a gold concentration of 0.5 moles per liter.

8. The process of claim 1 in which the concentration of cobalt or nickel is between 0.005 and 0.01 moles per liter.

9. The process of claim 1 in which the pH of the bath is 4±0.1.

10. The process of claim 1 in which the heat treatment is carried out for a time of approximately 15 minutes.

11. The process of claim 1 in which the gold electrical contact is used in a sealed, magnetically operated switch.

* * * * *